US012404849B2

(12) United States Patent
Bussmann et al.

(10) Patent No.: US 12,404,849 B2
(45) Date of Patent: Sep. 2, 2025

(54) MICROMEMBRANE PUMPING DEVICE

(71) Applicant: Fraunhofer-Gesellschaft zur Foerderung der angewandten Forschung e.V., Munich (DE)

(72) Inventors: Agnes Bussmann, Munich (DE); Lorenz Gruenerbel, Munich (DE); Christian Wald, Munich (DE); Sebastian Kibler, Munich (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 225 days.

(21) Appl. No.: 18/067,370

(22) Filed: Dec. 16, 2022

(65) Prior Publication Data

US 2023/0121697 A1 Apr. 20, 2023

Related U.S. Application Data

(63) Continuation of application No. PCT/EP2020/066821, filed on Jun. 17, 2020.

(51) Int. Cl.
*F04B 43/04* (2006.01)

(52) U.S. Cl.
CPC ..... *F04B 43/043* (2013.01); *F04B 43/046* (2013.01)

(58) Field of Classification Search
USPC ..... 417/413
See application file for complete search history.

(56) References Cited

U.S. PATENT DOCUMENTS 5,224,843 A * 7/1993 van Lintel ..... F04B 53/1092 137/859
5,622,901 A * 4/1997 Fukada ..... G01L 1/2262 438/10

(Continued)

FOREIGN PATENT DOCUMENTS

AU 2015308144 A1 4/2017
DE 19706513 A1 8/1998

(Continued)

OTHER PUBLICATIONS

Machine Translation JP-2001132646 (Obtained from USPTO Search) (Year: 2024).*

*Primary Examiner* — Dominick L Plakkoottam
*Assistant Examiner* — Geoffrey S Lee
(74) *Attorney, Agent, or Firm* — Perkins Coie LLP; Michael A. Glenn

(57) ABSTRACT

What is suggested is a micromembrane pumping device for pumping a fluid, having: a pump chamber to which an inlet valve, an outlet valve, and a membrane device for varying a volume of the pump chamber are associated, wherein the membrane device has a plate-shaped actuator for deforming the membrane device; and influencing means for influencing the plate-shaped actuator and the volume of the pump chamber; wherein the membrane device has a plate-shaped membrane body limiting the pump chamber; wherein the plate-shaped actuator is arranged on a side of the plate-shaped membrane body facing away from the pump chamber; wherein the plate-shaped actuator is mounted to and electrically insulated from the plate-shaped membrane body by an electrically insulating glue layer; wherein at least one embedded portion of a support body at or in which a deformation sensor for detecting a deformation of the membrane device is arranged, is arranged within the glue layer to detect the volume of the pump chamber; wherein the influ- (Continued)

encing means, the plate-shaped actuator and the deformation sensor form a closed-loop control circuit for regulating a volume flow.

21 Claims, 6 Drawing Sheets

(56) References Cited

U.S. PATENT DOCUMENTS 6,164,933 A 12/2000 Tani et al.
6,261,066 B1* 7/2001 Linnemann ..... F16K 99/0007 417/413.1
6,543,110 B1* 4/2003 Pelrine ..... F04B 35/045 29/594
2003/0173873 A1* 9/2003 Bryant ..... F04B 43/095 310/365
2011/0292630 A1* 12/2011 Yamaguchi ..... B60C 23/0493 361/807
2011/0296722 A1* 12/2011 Lukas ..... F04B 43/095 38/77.1
2012/0224981 A1* 9/2012 Fouillet ..... F04B 43/043 417/63
2013/0000758 A1* 1/2013 Hoen ..... F04B 43/046 137/565.01
2013/0000759 A1 1/2013 Killeen et al.
2013/0055889 A1* 3/2013 Herz ..... F16K 99/0001 92/96
2013/0209277 A1* 8/2013 Locke ..... F04B 43/043 417/63
2013/0209278 A1* 8/2013 Locke ..... F04B 43/046 417/313
2013/0209281 A1* 8/2013 Locke ..... F04F 7/00 417/63
2016/0153444 A1 6/2016 Chappel et al.
2018/0010589 A1 1/2018 Zeyen
2021/0060553 A1* 3/2021 Röhl ..... B29C 65/4835
2021/0190065 A1* 6/2021 Ferden ..... F04B 51/00
2023/0121697 A1* 4/2023 Bussmann ..... F04B 43/046 417/413.3

FOREIGN PATENT DOCUMENTS

DE 19918694 A1 11/1999
DE 102005058080 A1 6/2007
EP 1128075 A2 8/2001
JP 2001132646 A * 5/2001
JP 2018066276 A 4/2018
WO 2016030836 A1 3/2016

* cited by examiner

MICROMEMBRANE PUMPING DEVICE

CROSS-REFERENCE TO RELATED APPLICATION

This application is a continuation of copending International Application No. PCT/EP2020/066821, which is incorporated herein by reference in its entirety.

BACKGROUND OF THE INVENTION

The present invention relates to a micromembrane pumping device for pumping a fluid. Micromembrane pumping devices are known, for example, from documents AU 2015308144 A1 and US 20160153444 A1.

SUMMARY

According to an embodiment, a micromembrane pumping device for pumping a fluid may have: a pump chamber to which an inlet valve for introducing the fluid into the pump chamber, an outlet valve for discharging the fluid from the pump chamber, and a membrane device for varying a volume of the pump chamber are associated, the membrane device having a plate-shaped actuator for deforming the membrane device; and influencing means for influencing the plate-shaped actuator so as to influence the volume of the pump chamber; wherein the membrane device has a plate-shaped membrane body limiting the pump chamber; wherein the plate-shaped actuator is arranged on a side of the plate-shaped membrane body facing away from the pump chamber; wherein the plate-shaped actuator is mounted to the plate-shaped membrane body by means of an electrically insulating glue layer such that the plate-shaped actuator is electrically insulated from the membrane body; wherein at least one embedded portion of a support body at which or in which a deformation sensor for detecting a deformation of the membrane device is arranged, is arranged within the electrically insulating glue layer so as to detect the volume of the pump chamber; wherein the influencing means, the plate-shaped actuator and the deformation sensor form a closed loop control loop for regulating a ratio between a change in volume of the pump chamber during an operating cycle of the micromembrane pumping device and a duration of the operating cycle of the micromembrane pumping device.

The fluid to be pumped may be a liquid or a gas. The pump chamber is a closed cavity into which the respective fluid is introduced via an inlet valve and from which the respective fluid is discharged via an outlet valve. The inlet valve and the outlet valve may each be passive valves.

The membrane device is part of a housing which surrounds the pump chamber and is deformable elastically such that the volume of the pump chamber changes such that, when the volume increases, the fluid is sucked into the pump chamber and, when the volume decreases, the fluid is ejected from the pump chamber. By periodically increasing and decreasing the volume of the pump chamber, a defined volume flow of the fluid can be caused.

In order to cause such changes in volume of the pump chamber, the membrane device comprises a plate-shaped actuator configured for deforming the membrane device such that the volume of the pump chamber changes. The plate-shaped actuator advantageously is an electrically operated actuator.

A plate-shaped implementation of a body in this case means that the body comprises a considerably smaller dimension in one spatial direction than in the other two spatial directions. The actuator may be implemented to be round or polygonal in top view.

Additionally, influencing means is provided, which influences the plate-shaped actuator so as to influence the desired change in volume of the pump chamber. The influencing means may be electrical influencing means which generates electrical signals fed to the actuator in order to influence the same.

The membrane device comprises an elastically deformable membrane body which limits the pump chamber and is implemented to be plate-shaped. The membrane body may, for example, be mounted to a frame or holder of the housing. However, it may also be implemented to be integrated with other parts of the housing.

The plate-shaped actuator is arranged on a side of the plate-shaped membrane body facing away from the pump chamber. This means that it is not in direct contact to the fluid to be pumped, which particularly makes transmitting electrical signals from the influencing means to the actuator easier.

Thus, the plate-shaped actuator is mounted to the plate-shaped membrane body by means of an electrically insulating glue layer. The glue layer here is configured for transmitting forces from the actuator to the membrane body so as to allow deformation of the membrane body and, thus, a change in volume of the pump chamber. The electrically insulating implementation of the glue layer causes the plate-shaped actuator to be electrically insulated from the membrane body. This means that it is possible to use a plate-shaped actuator which is supplied electrically, irrespective of ground, on its side facing the membrane body, even if the membrane body is electrically conducting.

The actuator can comprise a height between 30 μm and 2000 μm, in particular between 45 μm and 1500 μm so as to ensure the necessary forces. It is to exhibit high rigidity, good adhering characteristics, resistance to environmental influences (humidity, solvents, temperature, radiation (which is frequently used in medical apparatuses for sterilization purposes)). Additionally, it is to be resistant to breaking, resistant to fatigue and electrically resistant to breakdown.

The electrically insulating implementation of the glue layer is also of advantage when the membrane body is implemented to be electrically insulating, since in this case an electrical field strength between the actuator and the fluid to be pumped is decreased so that electrical arcing between the actuator and the fluid can be prevented. This is of particular advantage when the plate-shaped actuator is operated at higher electrical voltages, for example in a range between 20 V and 400 V.

The glue layer is to be formed as thin as possible on both sides of the embedded portion of the support body. It is to exhibit high rigidity, good adhering characteristics, resistance to environmental influences (humidity, solvents, temperature, radiation (which is frequently used in medical apparatuses for sterilization purposes)). Additionally, it is to be resistant to breaking, resistant to fatigue, non-conducting and electrically resistant to breakdown.

Within the electrically insulating glue layer, there is an embedded portion of a support body at the surface of which or within which a deformation sensor is arranged which can detect the volume of the pump chamber over time by detecting a deformation of the membrane device.

The embedded portion of the support body may be thinner than 500 μm so as to ensure the necessary flexibility. It is to exhibit high rigidity, good adhering characteristics, resistance to environmental influences (humidity, solvents, temperature, radiation (which is frequently used in medical apparatuses for sterilization purposes)). Additionally, it is to be resistant to breaking, resistant to fatigue, non-conducting and electrically resistant to breakdown.

The influencing means, the plate-shaped actuator and the deformation sensor here form a closed loop control circuit for regulating the ratio, caused by the micromembrane pumping device, between a change in volume of the pump chamber (2) during an operating cycle of the micromembrane pumping device (1) and a duration of the operating cycle of the fluid.

A closed-loop control circuit generally means a self-contained loop for influencing a physical quantity in a technical process or other system. The direct or indirect feedback of the current value of the controlled variable to the regulator, which counteracts a deviation from a set value (negative feedback), is the essential point here. The object of the regulator is adjusting disturbance quantities and determining the time behavior of the controlled variable relative to the static and dynamic behavior in accordance with predetermined requirements.

In the present invention, the influencing means performs the task of a regulator. The controlled variable here is the ratio between the change in volume of the pump chamber during an operating cycle of the micromembrane pumping device and a duration of the operating cycle. The operating cycle comprises a phase in which the fluid is introduced into the pump chamber via the inlet valve, and another phase in which the fluid is discharged via the outlet valve. In disturbance-free operation, this ratio corresponds to the volume flow of the respective fluid. The volume flow is measured indirectly from knowing the duration of the operating cycle, which is predetermined by the influencing means, and from knowing the deformation of the membrane device detected by means of the deformation sensor.

The indirect measurements are transmitted to influencing means so that, in the case of a deviation of the volume flow from a set value, driving the plate-shaped actuator can be changed so as to result in the desired volume flow. In particular, the volume flow can be influenced by increasing or decreasing the amplitude of the change in volume of the pump chamber. Also, a frequency of the change in volume of the pump chamber can be increased or decreased.

It has been shown that such an indirect measurement of the volume flow is considerably faster and more precise, and also easier and cheaper than a direct measurement of the volume flow using well-known flow rate sensors which exemplarily comprise an impeller so that disturbance quantities can be adjusted considerably better. Additionally, the suggested micromembrane pumping device is superior to such pumping devices in which individual disturbance quantities, like temperature and pressures, are detected by sensors and used in an open-loop control circuit of the pumping device.

The volume flow can be controlled considerably more precisely using the suggested control circuit than is the case when using unregulated control means. Using a deformation sensor and its arrangement in the glue layer between the membrane body and the actuator allows highly precise feedback of the real value of the volume flow to the influencing means.

Thus, external influences, also referred to as disturbance quantities, on the volume flow can be adjusted precisely. Disturbance quantities which can be adjusted by the inventive micromembrane pumping device are:

- Pressures, for example the pressure of the fluid upstream of the inlet valve, the pressure of the fluid downstream of the outlet valve, or the pressure outside the membrane device.
- Temperatures, for example of the fluid or the environment of the micromembrane pumping device, which may result in tensing the membrane device or in a changed characteristic curve of the actuator. In a piezoceramic actuator, for example, the technically relevant d31 coefficient is temperature-dependent.
- Changes in the fluid characteristics, which may result in a change in the effective change in volume of the pump chamber when constantly driving the actuator, in particular when feeding liquids. Here, a change in viscosity, for example, caused by a change in temperature or a change in a fluid composition, results in different flow-in and flow-out times and, consequently, in a different volume flow.
- Tolerances of the mechanical components of the micromembrane pumping device, for example of the housing of the pump chamber, the inlet valve, the outlet valve, the actuator or the membrane body. Different volume flows in different micromembrane pumping devices of the same series due to geometrical deviations (bending, variations in thickness, parallelism faults) of the mechanical components can be avoided by this.
- Tolerances when connecting the mechanical components of the micromembrane pumping device, for example when implementing the glue layer.

The inventive micromembrane pumping device can be employed advantageously whenever highly precise dosing of a fluid is used, for example when mixing different fluids. In particular, it may be used in the medical field for dosing pharmaceuticals or for mixing components of pharmaceuticals.

In accordance with a further development of the invention, the glue layer is applied over an area, in particular the entire area, on a side of the plate-shaped actuator facing the membrane body, and/or the glue layer is applied over an area, in particular the entire area, on a side of the membrane body facing the plate-shaped actuator. In this way, forces generated by the actuator can be transmitted safely to the glue layer and from the glue layer to the membrane body. The result is, in particular, high rigidity of the arrangement and insensitivity towards high shear forces, which finally serves for dosing precision.

In accordance with a practical further development of the invention, the glue layer comprises cured liquid glue, cured gluing paste and/or adhesive film. Liquid glue, gluing pastes and adhesive films are easy to handle when manufacturing the membrane pumping device and exhibit sufficiently good adhering characteristics in order to securely transmit the required forces from the actuator to the membrane body, thereby increasing dosing precision.

In accordance with a further development of the invention, the glue layer comprises a temperature-curing material, an anaerobically curing material, a UV radiation-curing material, an activator-curing material, humidity-curing material, dry-curing material and/or hot-melt glue material. Such glue materials are easy to handle when manufacturing the membrane pumping device and exhibit sufficiently good adhering characteristics in order to securely transmit the required forces from the actuator to the membrane body, thereby increasing dosing precision.

In accordance with an advantageous further development of the invention, the plate-shaped actuator is an electromagnetic actuator, a single-layer or multi-layer piezoelectric actuator, a shape-memory actuator or a bimetal actuator. Single-layer piezoelectric actuators comprise an electrical terminal at their bottom and an electrical terminal at the top. Since, for the invention, the glue layer is non-conductive, the single-layer piezoelectric actuator may be fed symmetrically to ground. In the case of multi-layers, the two electrical contacts are arranged on that side facing the membrane body, thereby preventing short-circuiting the non-conducting characteristics of the glue layer. Shape-memory actuators or bimetal actuators can easily be used due to the insulating characteristics of the glue layer.

In accordance with a practical further development of the invention, the support body comprises one or more electrically insulating materials. Polyimides, for example, are particularly suitable.

In accordance with a practical further development of the invention, the support body comprises glass, one or more semiconductor materials, one or more composites, one or more polymeric materials or one or more ceramic materials.

In accordance with an advantageous further development of the invention, the deformation sensor is a strain gauge, in particular a resistive, capacitive or piezoresistive strain gauge.

In accordance with a practical further development of the invention, the deformation sensor is a force sensor.

In accordance with a practical further development of the invention, the membrane body comprises a metal, semiconductor material and/or plastic.

In accordance with a practical further development of the invention, at least a part of evaluation electronics for evaluating signals of the deformation sensor is arranged at or in the support body. The disturbance resistance can be improved by this, which finally increases dosing precision.

In accordance with a further development of the invention, the influencing means is implemented for recognizing operating disturbances of the micromembrane pumping device using measuring signals of the deformation sensor. During operation of the micromembrane pumping device, operating disturbances may occur. For example, the inlet valve or the outlet valve may be blocked by particles, the actuator may fail, an air bubble may reach the pump chamber in the case of a liquid fluid, and the like. Such disturbances are recognizable in the measuring signals of the deformation sensor since they influence the deformation of the membrane means or directly influence the actuator.

In accordance with a practical further development of the invention, the support body comprises a non-embedded portion which is led out from the glue layer, wherein contacts for tapping measuring signals of the deformation sensor which are electrically connected to the deformation sensor are attached to the non-embedded portion. The electrical connections between the contacts for the deformation sensor and the deformation sensor thus may be implemented at or in the support body so that these are mechanically protected and electrically insulated from both the actuator and the membrane body.

In accordance with a practical further development of the invention, a heating wire is arranged at or in the embedded portion. The heating wire allows heating the fluid to be pumped. Additionally, the heating wire may be used during manufacturing of the micromembrane pumping device for heating the glue layer, for curing the same in case the glue layer comprises a temperature-curing material. A heating wire here may be provided with electrical energy by the influencing means or by external means.

In accordance with a practical further development of the invention, the support body comprises a non-embedded portion which is led out from the glue layer, wherein contacts for providing the heating wire with electrical energy which are electrically connected to the heating wire, are attached to the non-embedded portion. The electrical connections between the contacts for the heating wire and the heating wire may be formed at or in the support body so that these are mechanically protected and electrically insulated from both the actuator and the membrane body.

In accordance with a practical further development of the invention, a temperature sensor is arranged at or in the embedded portion. Measuring signals of the temperature sensor may be fed, for example, to the influencing means or external means which provides the heating wire with electrical energy. In this way, the heating effect of the heating wire can be regulated during manufacturing the micromembrane pumping device or during operation of the micromembrane pumping device.

In accordance with a practical further development of the invention, the support body comprises a non-embedded portion which is led out from the glue layer, wherein contacts for tapping measuring signals of the temperature sensor which are electrically connected to the temperature sensor, are attached to the non-embedded portion. The electrical connections between the contacts for the temperature sensor and the temperature sensor can be formed at or in the support body so that these are mechanically protected and electrically insulated from both the actuator and the membrane body.

In accordance with an advantageous further development of the invention, a state sensor, in particular a humidity sensor or a chemical sensor, for checking a state of the glue layer is arranged at or in the embedded portion. The measuring signals of the state sensor may be fed to the influencing means. In this way, the influencing means can recognize an age-induced deterioration of the state of the glue layer, or deterioration caused by internal influence, before the glue layer fails which is of advantage in particular in medical applications.

In accordance with an advantageous further development of the invention, the support body comprises a non-embedded portion which is led out from the glue layer, wherein contacts for tapping measuring signals of the state sensor which are electrically connected to the state sensor are attached to the non-embedded portion. The electrical connections between the contacts for the state sensor and the state sensor may be formed at or in the support body so that these are mechanically protected and electrically insulated from both the actuator and the membrane body.

In accordance with a practical further development of the invention, the embedded portion of the support body, when viewed in a direction from the plate-shaped actuator towards the plate-shaped membrane body, comprises an area smaller than an area of the plate-shaped membrane body facing the embedded portion of the support body, and smaller than an area of the plate-shaped actuator facing the embedded portion of the support body. In this way, it can be ensured that the glue layer is at least partly continuous from the actuator to the membrane body in the indicated direction. The result is a particularly good force transmission between the actuator and the membrane body.

In accordance with an advantageous further development of the invention, the embedded portion of the support body comprises at least one through hole which extends from a side of the embedded portion of the support body, facing the plate-shaped actuator, to a side of the embedded portion of the support body facing the plate-shaped membrane body. This causes the glue layer to extend without interruption from the actuator to the membrane body in the region of the through hole in the direction from the actuator towards the membrane body. The result is a particularly good force transmission between the actuator and the membrane body.

In accordance with a practical further development of the invention, the embedded portion of the support body, when viewed in a direction from the plate-shaped actuator towards the plate-shaped membrane body, comprises an edge comprising recesses. The glue layer extends without interruptions from the actuator to the membrane body in the region of the recesses. Since a large part of the forces generated by the actuator is transmitted on the glue layer in an edge region of the actuator, the result is a particularly good force transmission from the actuator to the membrane body.

BRIEF DESCRIPTION OF THE DRAWINGS

Embodiment of the present invention and its advantages will be described in greater detail below referring to the figures, in which.

DETAILED DESCRIPTION OF THE INVENTION

Figure 1:
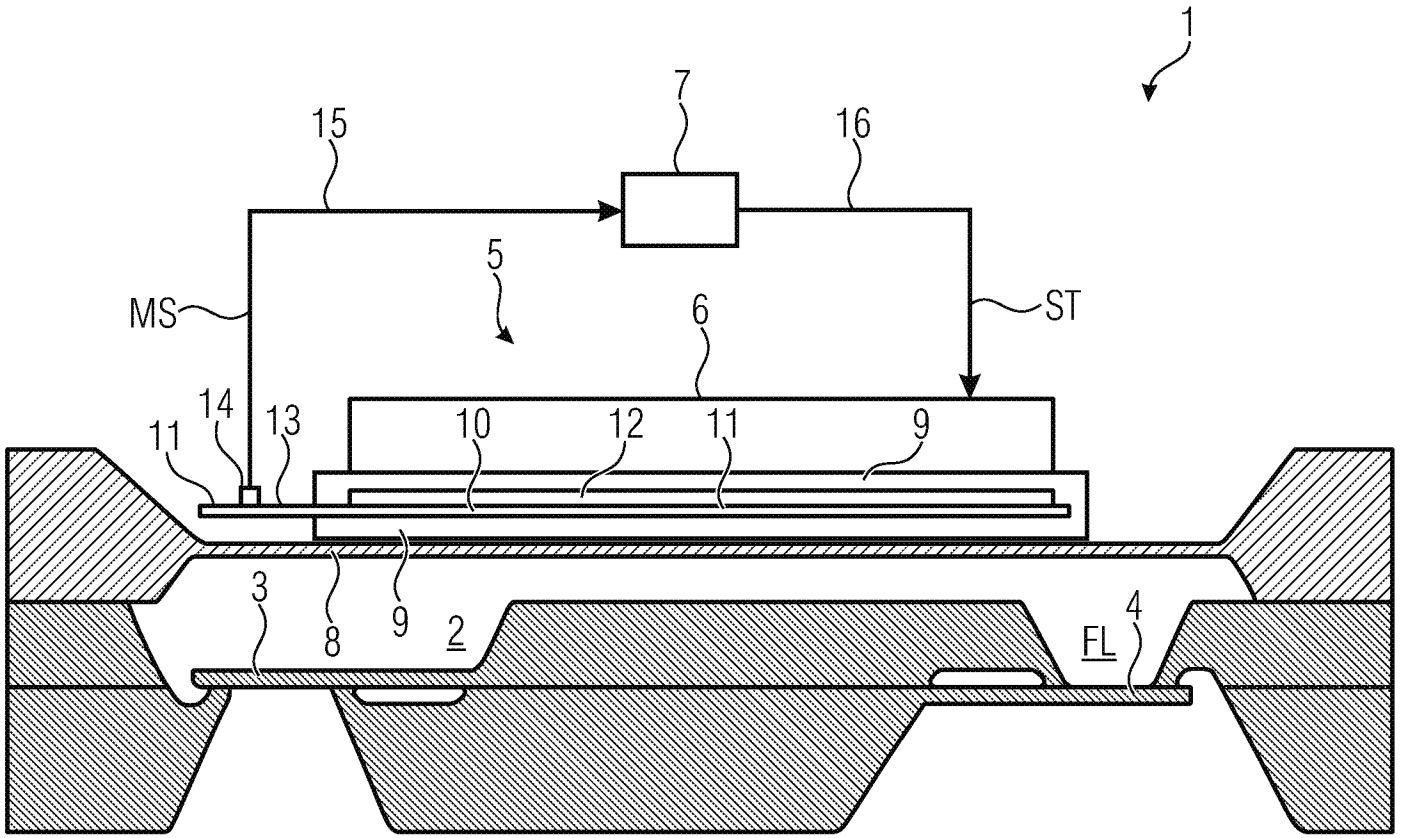
FIG. 1 shows a first embodiment of a micromembrane pumping device in accordance with the present invention in a schematic side view.

Same or uniform elements or elements of equal or equivalent function will subsequently be provided with same or uniform reference numerals.

In the following description, embodiments having a plurality of features of the present invention will be described in more detail so as to provide better understanding of the invention. However, it is to be stated that the present invention may also be realized while omitting certain of the described features. It is also to be pointed out that the features shown in different embodiments may also be combined differently, provided this is not excluded explicitly or would result in contradictions.

FIG. 1 shows a first embodiment of a micromembrane pumping device 1 in accordance with the present invention in a schematic side view.

The micromembrane pumping device 1 for pumping a fluid FL comprises:

a pump chamber 2 to which an inlet valve 3 for introducing the fluid FL into the pump chamber 2, an outlet valve 4 for discharging the fluid FL from the pump chamber 2, and a membrane device 5 for varying a volume of the pump chamber 1 are associated, wherein the membrane device 5 comprises a plate-shaped actuator 6 for deforming the membrane device 5; and influencing means 7 for influencing the plate-shaped actuator 6 so as to influence the volume of the pump chamber 2;

wherein the membrane device 5 comprises a plate-shaped membrane body 8 limiting the pump chamber 2;

wherein the plate-shaped actuator 6 is arranged on a side of the plate-shaped membrane body 8 facing away from the pump chamber 2;

wherein the plate-shaped actuator 6 is mounted to the plate-shaped membrane body 8 by means of an electrically insulating glue layer 9 so that the plate-shaped actuator 6 is electrically insulated from the membrane body 8;

wherein at least one embedded portion 10 of a support body 11 at which or in which a deformation sensor 12 for detecting a deformation of the membrane device 5 is arranged, is arranged within the electrically insulating glue layer 9 in order to detect the volume of the pump chamber 2;

wherein the influencing means 7, the plate-shaped actuator 6 and the deformation sensor 12 form a closed-loop control circuit for regulating a ratio between a change in volume of the pump chamber (2) during an operating cycle of the micromembrane pumping device (1) and a duration of the operating cycle of the micromembrane pumping device 1.

In accordance with a further development of the invention, the glue layer 9 is applied over an area, in particular the entire area, on a side of the plate-shaped actuator 6 facing the membrane body 8 and/or the glue layer 9 is applied over an area, in particular the entire area, on a side of the membrane body 8 facing the plate-shaped actuator 6.

According to an advantageous further development of the invention, the glue layer 9 comprises a cured liquid glue, a cured gluing paste and/or adhesive film.

In accordance with an advantageous development of the invention, the glue layer 9 comprises a temperature-curing material, an anaerobically curing material, a UV radiation-curing material, an activator-curing material, a humidity-curing material, a dry-curing material and/or a hot-melt glue material.

In accordance with a practical further development of the invention, the plate-shaped actuator 6 is an electromagnetic actuator, a single-layer or multi-layer piezoelectric actuator, a shape-memory actuator or a bimetal actuator.

In accordance with an advantageous further development of the invention, the support body 11 comprises one or more electrically insulating materials.

In accordance with a practical further development of the invention, the support body 11 comprises glass, one or more semiconductor materials, one or more composites, one or more polymeric materials or one or more ceramic materials.

According to an advantageous further development of the invention, the deformation sensor 12 is a strain gauge, in particular a resistive, capacitive or piezoresistive strain gauge.

According to a practical further development of the invention, the deformation sensor 12 is a force sensor.

In accordance with a practical further development of the invention, the membrane body 8 comprises a metal, semiconductor material and/or plastic.

In accordance with a practical further development of the invention, at least a part of evaluation electronics for evaluating signals of the deformation sensor 12 is arranged at or in the support body 11.

In accordance with a practical further development of the invention, the influencing means 7 is configured for recognizing operating disturbances of the micromembrane pumping device 1 using measuring signals MS of the deformation sensor 12.

In accordance with a practical further development of the invention, the support body 11 comprises a non-embedded portion 13 which is led out from the glue layer 9, wherein contacts 14 for tapping measuring signals MS of the deformation sensor which are electrically connected to the deformation sensor are attached to the non-embedded portion 13.

In the embodiment of FIG. 1, the deformation sensor 12 is electrically connected to contacts 14 arranged at the non-embedded portion 13 of the support body 11. The contacts 14 in turn are electrically connected to the influencing means 7 via a measuring line 15 so that measuring signals MS of the deformation sensor 12 can be transmitted to the influencing means 7. Based on measuring signals MS, the influencing means 7 generates control signals ST transmitted to the actuator 6 via a control line 16 and controlling the same. The control signals ST may also serve for supplying energy to the actuator 6.

Figure 2:
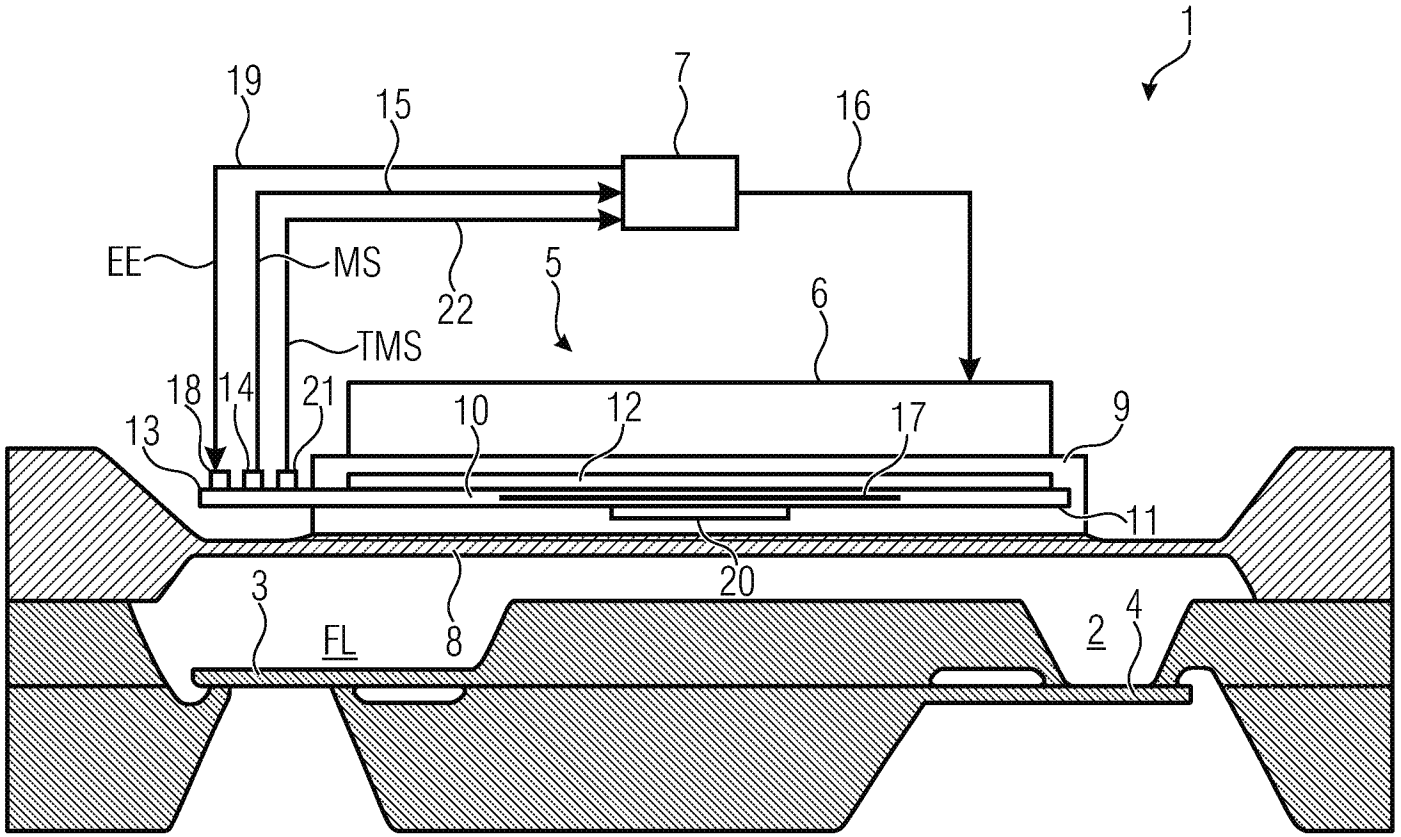
FIG. 2 shows a second embodiment of a micromembrane pumping device according to the present invention in a schematic side view.

FIG. 2 shows a second embodiment of a micromembrane pumping device 1 in accordance with the present invention in a schematic side view. The embodiment of FIG. 2 is based on the embodiment of FIG. 1 so that only the differences will be described and explained below.

In accordance with a further development of the invention, a heating wire 17 is arranged at or in the embedded portion 10.

According to an advantageous further development of the invention, the support body 11 comprises a non-embedded portion 13 which is led out from the glue layer 9, wherein contacts 18 for providing the heating wire 17 with electrical energy EE which are electrically connected to the heating wire 17 are attached to the non-embedded portion 13.

According to an advantageous further development of the invention, a temperature sensor 20 is arranged at or in the embedded portion 10.

In accordance with a practical further development of the invention, the support body 11 comprises a non-embedded portion 13 which is led out from the glue layer 9, wherein contacts 21 for tapping measuring signals TMS of the temperature sensor 20 which are electrically connected to the temperature sensor 20 are attached to the non-embedded portion 13.

In the embodiment of FIG. 2, the heating wire 17 is electrically connected to contacts 18 formed at the non-embedded portion 13 of the support body 11. The contacts 18 are connected to the influencing means 7 via a supply line 19 so that the influencing means 7 can supply the heating wire 17 with electrical energy EE. Thus, the fluid FL can be heated in a manner controlled by the influencing means 7. Additionally, while manufacturing the micromembrane pumping device 1, the glue layer 9 can be heated so as to cure the same. The electrical energy EE, however, may also be provided by means independent from the influencing means 7.

Additionally, the temperature sensor 20 is connected to contacts 21 formed at the non-embedded portion 13 of the support body 11. The contacts 21 are connected to the influencing means 7 via a measuring line 22 so that measuring signals TMS of the temperature sensor 20 can be transmitted to the influencing means 7. The measuring signals TMS can be used by the influencing means 7 to regulate the heat power of the heating wire 17.

Figure 3:
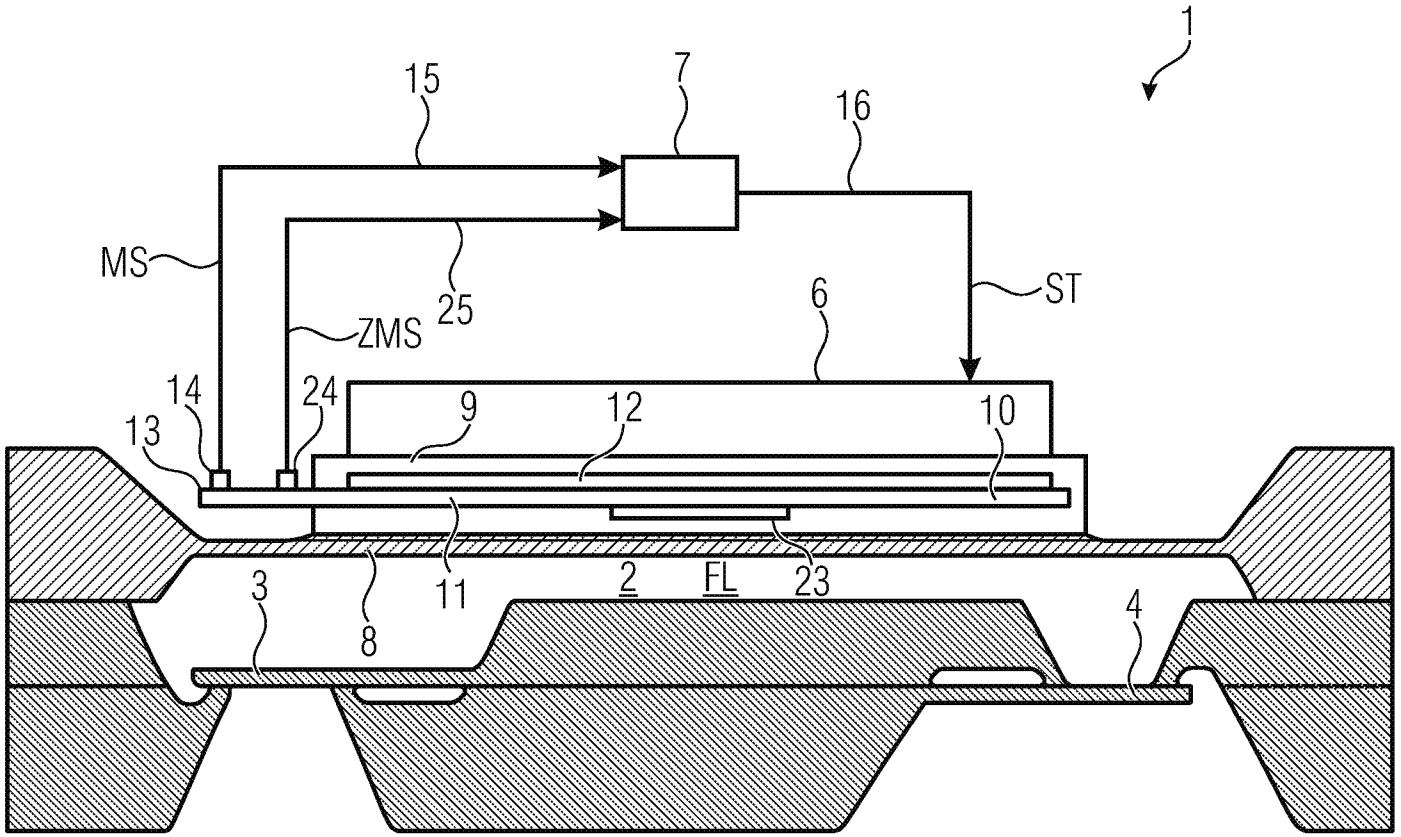
FIG. 3 shows a third embodiment of a micromembrane pumping device in accordance with the present invention in a schematic side view.

FIG. 3 shows a third embodiment of a micromembrane pumping device 1 in accordance with the present invention in a schematic side view. The embodiment of FIG. 3 is based on the embodiment of FIG. 1 so that only the differences will be described and explained below.

According to an advantageous further development of the invention, a state sensor 23, in particular a humidity sensor or a chemical sensor, for checking a state of the glue layer 9 is arranged at or in the embedded portion 10.

According to a practical further development of the invention, the support body 11 comprises a non-embedded portion 13 which is led out from the glue layer 9, wherein contacts 24 for tapping measuring signals ZMS of the state sensor 23 which are electrically connected to the state sensor 23 are attached to the non-embedded portion 13.

In the embodiment of FIG. 3, a state sensor 23 is electrically connected to contacts 24 which are formed at the non-embedded portion 13 of the support body 11 and are electrically connected to the influencing means 7 via a measuring line 25 so that measuring signals ZMS of the state sensor 23 can be transmitted to the influencing means 7. The measuring signals ZMS may be used by the influencing means 7 for early recognition of malfunctioning of the micromembrane pumping device 1 caused by damage to the glue layer 9.

Figure 4:
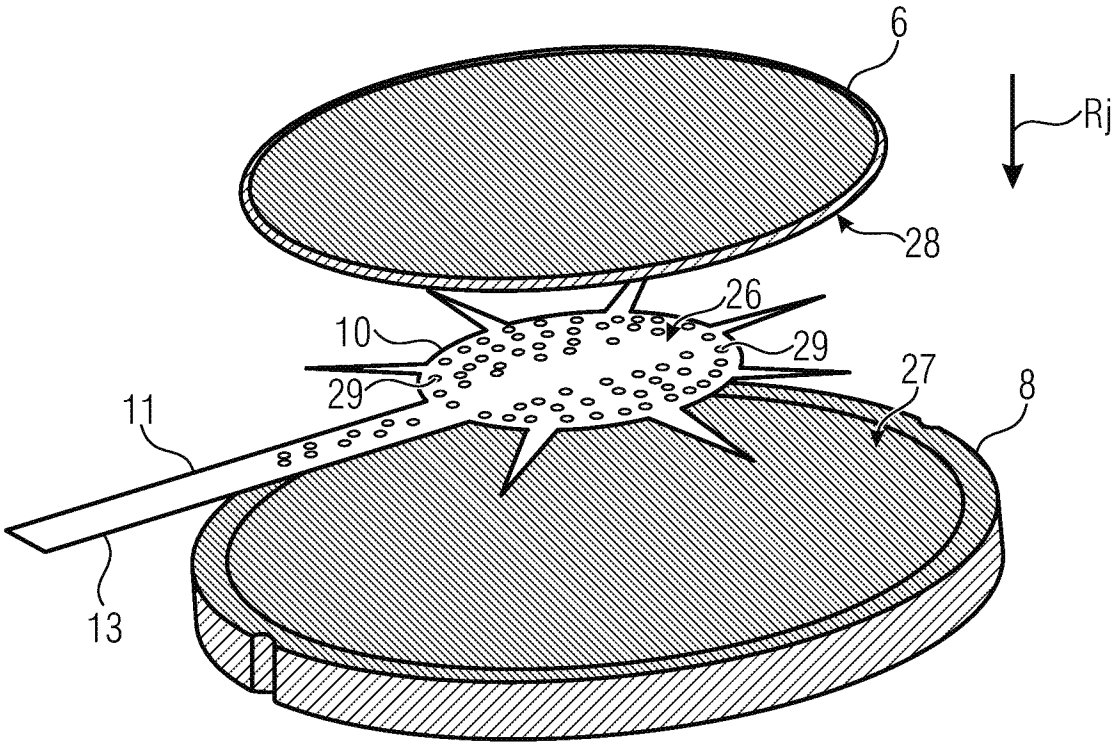
FIG. 4 shows an exemplary actuator, an exemplary support body and an exemplary membrane body for a micromembrane pumping device in accordance with the present invention in a schematic three-dimensional explosive view.

FIG. 4 shows an exemplary actuator 6, an exemplary support body 11 and an exemplary membrane body 8 for a micromembrane pumping device 1 according to the present invention in a schematic three-dimensional explosive illustration.

In accordance with an advantageous further development of the invention, the embedded portion 10 of the support body 11, when viewed in a direction RI from the plate-shaped actuator 6 towards the plate-shaped membrane body 8, comprises an area 26 which is smaller than an area 27 of the plate-shaped membrane body 8 which faces the embedded portion 10 of the support body 11, and which is smaller than an area 28 of the plate-shaped actuator 6 which faces the embedded portion 10 of the support body 11.

In accordance with a practical further development of the invention, the embedded portion 10 of the support body 11 comprises at least one through hole 29 which extends from a side of the embedded portion 10 of the support body 11 facing the plate-shaped actuator 6 to a side of the embedded portion 10 of the support body 11 facing the plate-shaped membrane body 8.

Figure 5:
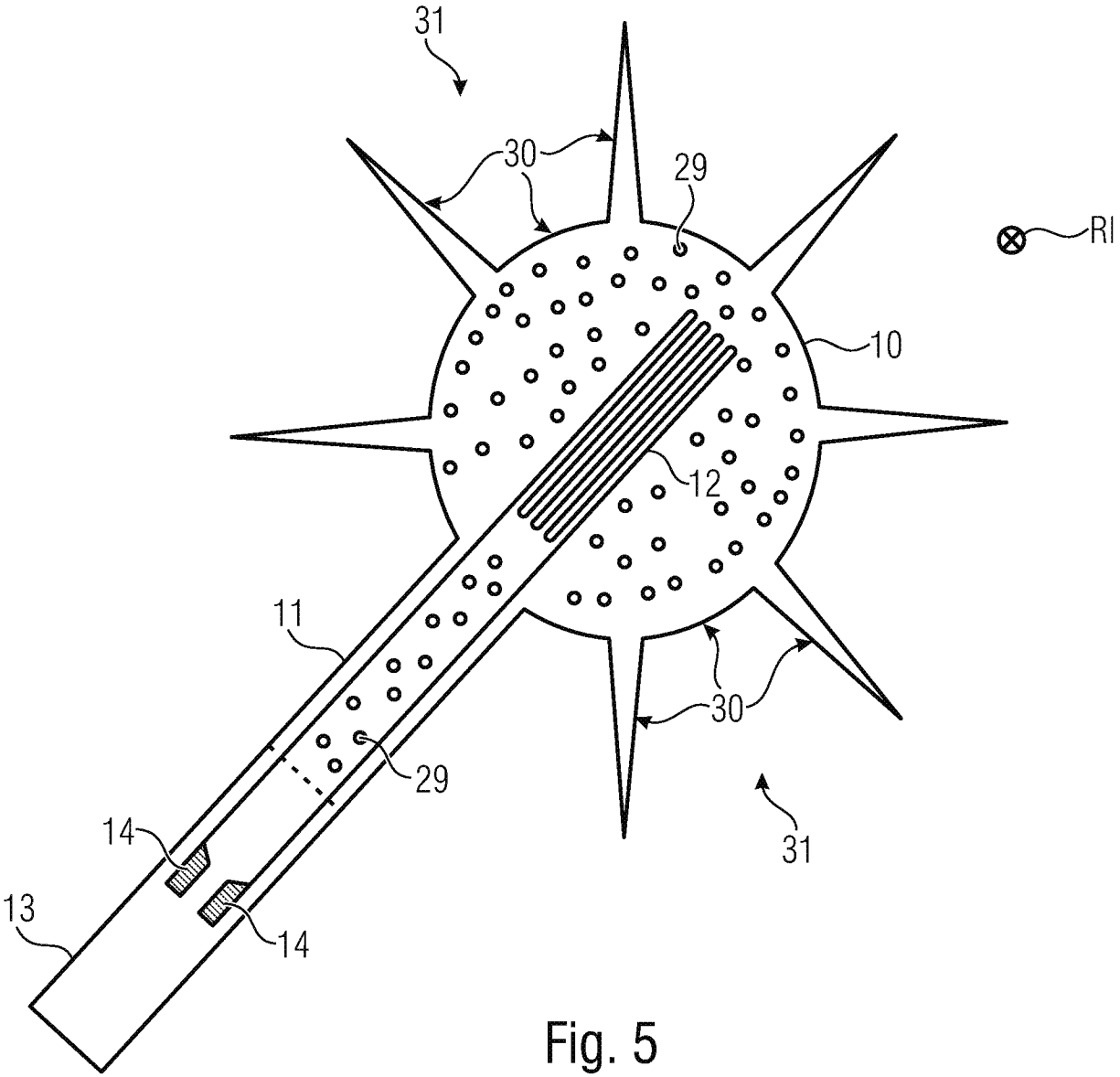
FIG. 5 shows an exemplary support body having an exemplary deformation sensor for a micromembrane pumping device in accordance with the present invention in a schematic top view.

FIG. 5 shows an exemplary support body in an exemplary deformation sensor 12 for a micromembrane pumping device 1 in accordance with the present invention in a schematic top view.

In accordance with an advantageous further development of the invention, the embedded portion 10 of the support body 11, when viewed in the direction RI from the plate-shaped actuator 6 towards the plate-shaped membrane body 8, comprises an edge 30 which comprises recesses 31.

Figure 6:
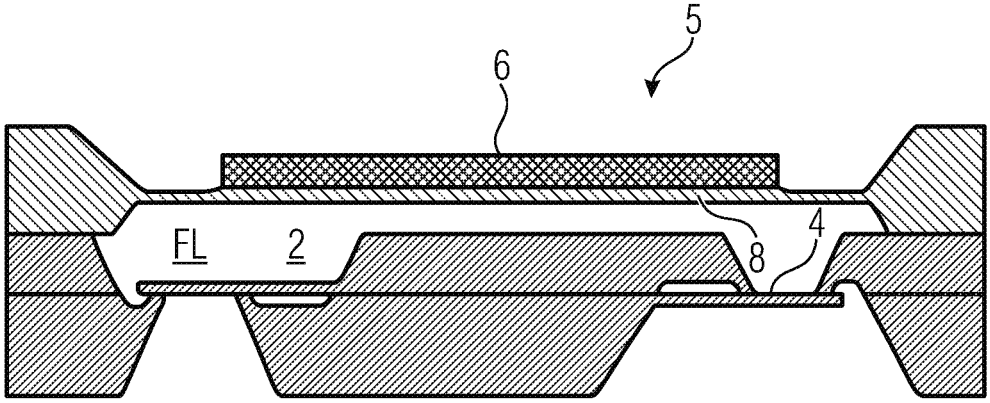
FIG. 6 shows a simplified partial view of a micromembrane pumping device in accordance with the present invention in a schematic side view in a rest state.

FIG. 6 shops a simplified partial view of a micromembrane pumping device 1 in accordance with the present invention in a schematic side view in a rest state. Thus, the actuator 6 is shown in its rest position so that the membrane body 8 is also in its rest position.

Figure 7:
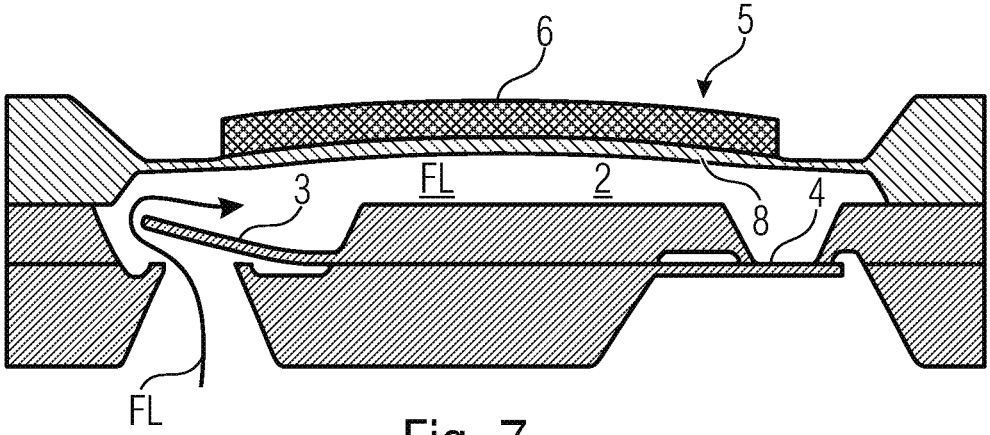
FIG. 7 shows a simplified partial view of a micromembrane pumping device in accordance with the present invention in a schematic side view when fluid is introduced.

FIG. 7 shows a simplified partial view of a micromembrane pumping device 1 in accordance with the present invention in a schematic side view when fluid FL is introduced. Thus, the actuator 6 is driven such that it moves such that, together with the membrane body 8, it increases the volume of the pump chamber 2 compared to that volume which the pump chamber 2 takes when the actuator 6 is in its rest position.

Figure 8:
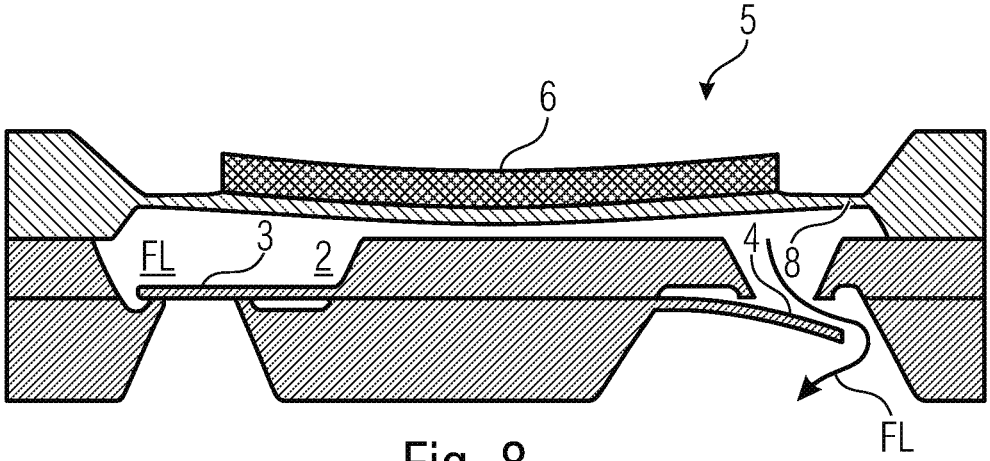
FIG. 8 shows a simplified partial view of a micromembrane pumping device in accordance with the present invention in a schematic side view when fluid is discharged.

FIG. 8 shows a simplified partial view of a micromembrane pumping device in accordance with the present invention in a schematic side view when fluid is discharged. Here, the actuator 6 is driven such that it moves such that, together with the membrane body 8, it decreases the volume of the pump chamber 2 compared to that volume which is taken by the pump chamber 2 when the actuator 6 is in its rest position.

The volume flow of the fluid FL can be generated by periodically moving the actuator 6 back and forth between the position shown in FIG. 7 and the position shown in FIG. 8. However, it is also conceivable for the volume flow of the fluid FL to be generated by moving the actuator 6 back and forth between the position shown in FIG. 6 and the position shown in FIG. 7. It is also conceivable for the volume flow of the fluid FL to be generated by moving the actuator 6 back and forth between the position shown in FIG. 6 and the position shown in FIG. 8.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. A micromembrane pumping device for pumping a fluid, comprising:

a pump chamber to which an inlet valve for introducing the fluid into the pump chamber, an outlet valve for discharging the fluid from the pump chamber, and a membrane device for varying a volume of the pump chamber are associated, wherein the membrane device comprises a plate-shaped actuator for deforming the membrane device; and an influencer for influencing the plate-shaped actuator so as to influence the volume of the pump chamber;

wherein the membrane device comprises a plate-shaped membrane body limiting the pump chamber;

wherein the plate-shaped actuator is arranged on a side of the plate-shaped membrane body facing away from the pump chamber;

wherein the plate-shaped actuator is mounted to the plate-shaped membrane body by means of an electrically insulating glue layer so that the plate-shaped actuator is electrically insulated from the membrane body;

wherein at least one embedded portion of a support body at which or in which a deformation sensor for detecting a deformation of the membrane device is arranged, is arranged within the electrically insulating glue layer in order to detect the volume of the pump chamber;

wherein the influencer, the plate-shaped actuator and the deformation sensor form a closed-loop control circuit for regulating a ratio between a change in volume of the pump chamber during an operating cycle of the micromembrane pumping device and a duration of the operating cycle of the micromembrane pumping device; and wherein the embedded portion of the support body, when viewed in a direction from the plate-shaped actuator towards the plate-shaped membrane body, comprises an area which is smaller than an area of the plate-shaped membrane body facing the embedded portion of the support body, and which is smaller than an area of the plate-shaped actuator facing the embedded portion of the support body.

2. The micromembrane pumping device in accordance with claim 1, wherein the glue layer is applied over an area on a side of the plate-shaped actuator facing the membrane body, and/or wherein the glue layer is applied over an area-on a side of the membrane body facing the plate-shaped actuator.

3. The micromembrane pumping device in accordance with claim 1, wherein the glue layer comprises a cured liquid glue, cured glue paste and/or adhesive film.

4. The micromembrane pumping device in accordance with claim 1, wherein the glue layer comprises a temperature-curing material, an anaerobically curing material, a UV radiation-curing material, an activator-curing material, humidity-curing material, dry-curing material and/or hot-melt glue material.

5. The micromembrane pumping device in accordance with claim 1, wherein the plate-shaped actuator is an electromagnetic actuator, a single-layer or multi-layer piezoelectric actuator, a shape-memory actuator or bimetal actuator.

6. The micromembrane pumping device in accordance with claim 1, wherein the support body comprises one or more electrically insulating materials.

7. The micromembrane pumping device in accordance with claim 1, wherein the support body comprises glass, one or more semiconductor materials, one or more composites, one or more polymeric materials or one or more ceramic materials.

8. The micromembrane pumping device in accordance with claim 1, wherein the deformation sensor is a strain gauge.

9. The micromembrane pumping device in accordance with any claim 1, wherein the deformation sensor is a force sensor.

10. The micromembrane pumping device in accordance with claim 1, wherein the membrane body comprises a metal, semiconductor material and/or plastic.

11. The micromembrane pumping device in accordance with claim 1, wherein at least a part for evaluating signals of the deformation sensor is arranged at or in the support body.

12. The micromembrane pumping device in accordance with claim 1, wherein the influencer is configured for recognizing operating disturbances of the micromembrane pumping device using measuring signals of the deformation sensor.

13. The micromembrane pumping device in accordance with claim 1, wherein the support body comprises a non-embedded portion which is led out from the glue layer, wherein contacts for tapping measuring signals of the deformation sensor which are electrically connected to the deformation sensor are attached to the non-embedded portion.

14. The micromembrane pumping device in accordance with claim 1, wherein a heating wire is arranged at or in the embedded portion.

15. The micromembrane pumping device in accordance with claim 14, wherein the support body comprises a non-embedded portion which is led out from the glue layer, wherein contacts for providing the heating wire with electrical energy which are electrically connected to the heating wire are attached to the non-embedded portion.

16. The micromembrane pumping device in accordance with claim 1, wherein a temperature sensor is arranged at or in the embedded portion.

17. The micromembrane pumping device in accordance with claim 16, wherein the support body comprises a non-embedded portion which is led out from the glue layer, wherein contacts for tapping measuring signals of the temperature sensor which are electrically connected to the temperature sensor are attached to the non-embedded portion.

18. The micromembrane pumping device in accordance with claim 1, wherein a state sensor for checking a state of the glue layer is arranged at or in the embedded portion.

19. The micromembrane pumping device in accordance with claim 18, wherein the support body comprises a non-embedded portion which is led out from the glue layer, wherein contacts for tapping measuring signals of the state sensor which are electrically connected to the state sensor are attached to the non-embedded portion.

20. The micromembrane pumping device in accordance with claim 1, wherein the embedded portion of the support body comprises at least one through hole which extends from a side of the embedded portion of the support body, facing the plate-shaped actuator, to a side of the embedded portion of the support body, facing the plate-shaped membrane body.

21. The micromembrane pumping device in accordance with claim 1, wherein the embedded portion of the support body, when viewed in the direction from the plate-shaped actuator towards the plate-shaped membrane body, comprises an edge which comprises recesses.

* * * * *